US005230542A

United States Patent [19]

Wiese

[11] Patent Number: 5,230,542

[45] Date of Patent: Jul. 27, 1993

[54] LATCH DOG ASSEMBLY

[75] Inventor: Delmar R. Wiese, Springfield, Mo.

[73] Assignee: Custom Metalcraft Inc., Springfield, Mo.

[21] Appl. No.: 849,205

[22] Filed: Mar. 11, 1992

[51] Int. Cl.[5] ..... E05C 1/04

[52] U.S. Cl. ..... 292/340; 292/241

[58] Field of Search ..... 292/58, 240, 241, 257, 292/340, 341.12, DIG. 15, DIG. 19, DIG. 71

[56] References Cited

U.S. PATENT DOCUMENTS

| | | | |
|---|---|---|---|
| 974,650 | 11/1910 | Ford | 292/240 |
| 1,374,731 | 4/1921 | Hage | 292/341.12 |
| 2,499,165 | 2/1950 | Roethel | 292/341.12 |
| 2,970,718 | 2/1961 | Jennings, Jr. | 292/241 |
| 3,130,855 | 4/1964 | Gunn, Jr. | 292/240 X |
| 3,567,263 | 3/1971 | McKinney | 292/241 |
| 4,896,908 | 1/1990 | Kleefeldt | 292/216 |

FOREIGN PATENT DOCUMENTS 2076922A 12/1981 United Kingdom ..... 292/DIG. 20

OTHER PUBLICATIONS

Catalog 97 McMaster-Carr Supply Co. Two shts dated Dec. 17, 1992, Dec. 14, 1992, resp. identifies "UHMW" as Ultra-High Mo. Wgt. Polyethylene.

*Primary Examiner*—Richard E. Moore

*Attorney, Agent, or Firm*—Nies, Kurz, Bergert & Tamburro

[57] ABSTRACT

A latch dog assembly for a hinged door in a bin for bulk material wherein the latch dog includes a housing with a wear block of UHMW polyethylene plastic or similar low friction material and with the assembly being constructed to ensure proper drainage during cleaning and so that pressure of the door cam retains the wear block in proper position.

7 Claims, 2 Drawing Sheets

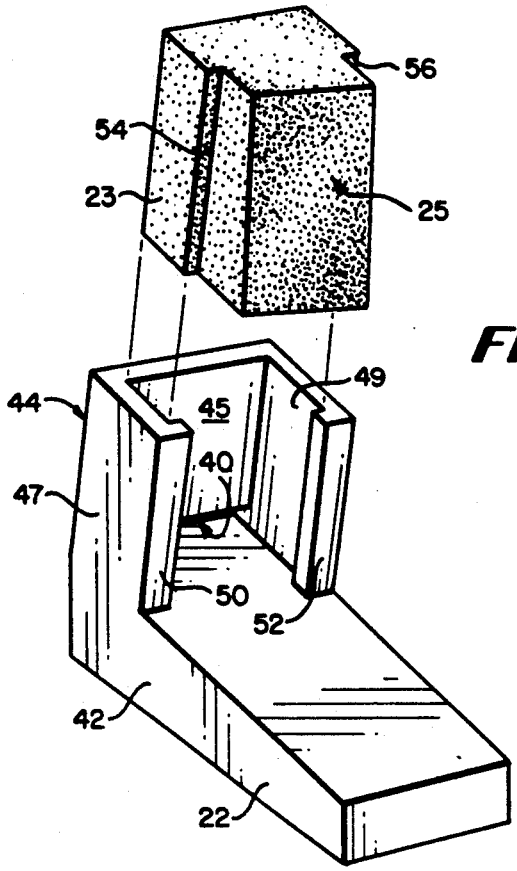
FIG. 3
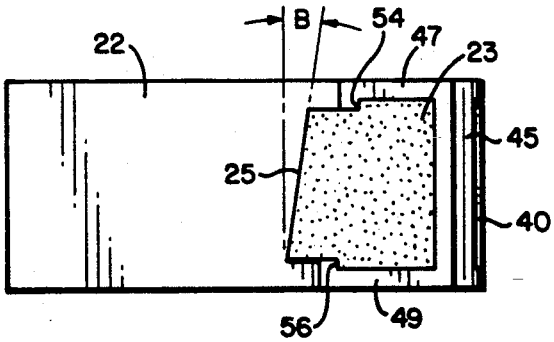
FIG. 4
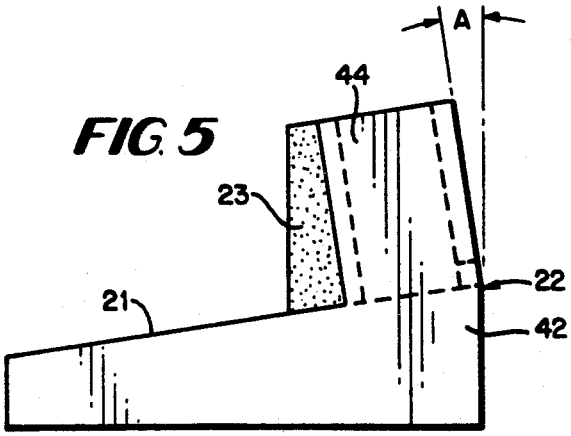
FIG. 5
FIG. 6
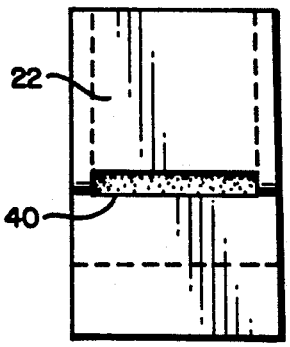

LATCH DOG ASSEMBLY

BACKGROUND AND SUMMARY OF THE INVENTION

The principal object of the present invention is to provide a durable latch dog assembly for containers to meet FDA, USDA, and other governmental requirements.

Previous door latch assemblies are described in the following U.S. Pat. Nos.: 974,650 to Ford; 2,499,165 to Roethel; 2,970,718 to Jennings; 3,130,855 to Gunn; 3,567,263 to McKinney; and 4,896,908 to Kleefeldt.

By the present invention there is provided an improved door latch assembly which is particularly well suited for use with containers having a hinged discharge door. The latch dog assembly of the present invention includes a latch dog housing which supports a wear block of UHMW (ultra-high molecular weight) polyethylene plastic or similar material. The assembly is constructed so that pressure of the door cam retains the wear block in proper position, while the wear block is easily removable to allow thorough cleaning. Operation of the closure avoids metal to metal contact between the door cam and the latch dog assembly.

Thus it is one object of the present invention to provide a latch dog assembly with an easily removable wear block so as to allow thorough cleaning and simple replacement without any special tools.

It is another object of the present invention to provide a latch dog assembly which will avoid metal to metal contact between the door cam and the latch dog assembly.

Further objects, features, and advantages of this invention will become more readily apparent from the following description taken in conjunction with the accompanying drawings.

BRIEF DESCRIPTION OF THE DRAWINGS

FIG. 3 is an exploded perspective view of the latch dog housing with wear block insert;

FIG. 4 is a top view of the latch dog housing with wear block insert;

FIG. 5 is a side view of the latch dog housing with wear block insert; and

FIG. 6 is an end view of the latch dog housing with wear block insert.

DESCRIPTION OF THE PREFERRED EMBODIMENTS

Figure 1:
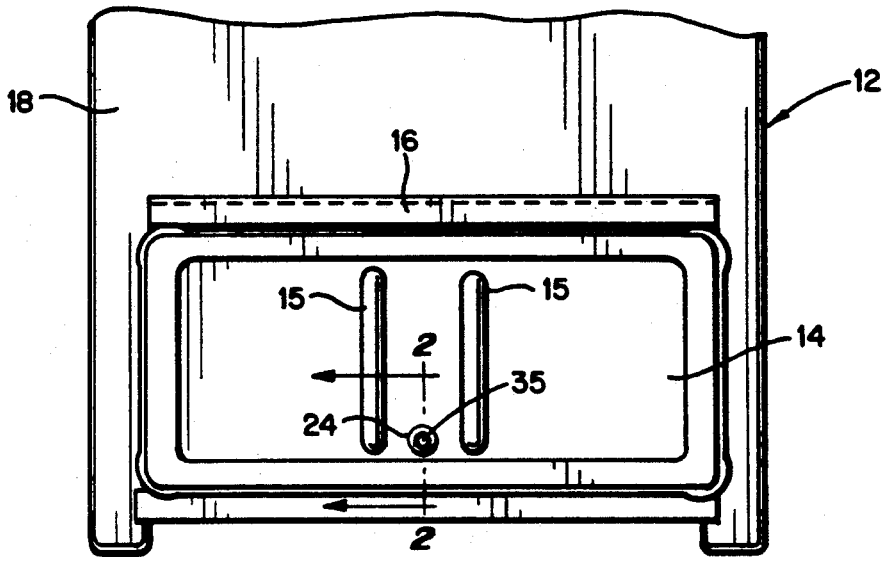
FIG. 1 is a front view of a storage bin provided with the improved latch dog assembly of this invention.
Figure 2:
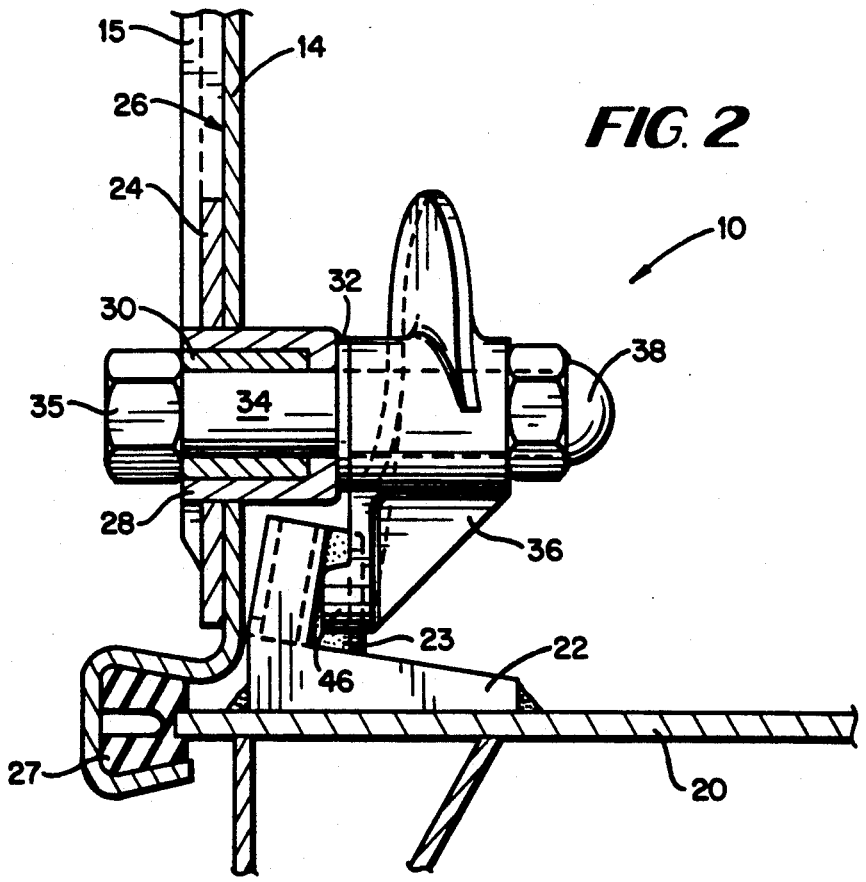
FIG. 2 is an enlarged fragmentary sectional view of the latch dog assembly of this invention taken along line 2—2 in FIG. 1.

In the embodiment of the invention as shown in FIGS. 1 through 6, there is provided an improved latch dog assembly, indicated generally at 10 in FIG. 2, which is shown in FIG. 1 in assembly relation with a storage bin 12 having a discharge door 14 attached by a hinge assembly 16 to a bin wall 18. The bin 12 also has an adjacent wall 20 as shown in FIG. 2 on which a latch dog housing 22 is mounted in a fixed position. A suitable gasket 27 is provided at the junction of the door 14 and the adjacent wall 20.

The door 14 has a pair of raised ribs 15 which can be formed into the door 14 and a reinforcing plate 24 secured to the outer surface 26 of the door 14. Inwardly of the reinforcing plate, there are located a bolt housing 28, a bushing 30 and a washer member 32.

A latch bolt 34 extends axially through the bolt housing 28 and through the washer member 32 and has a helical latch cam 36, the cam shape features of which are conventional, mounted on its inner end and maintained thereon in a fixed position by a nut 38. An enlarged head 35 is provided on the outer end of the latch bolt 34.

The latch dog housing 22 provides a three-sided enclosure for a wear block insert 23 made of UHMW polyethylene plastic or similar material, as shown in FIG. 3. The latch dog housing 22 has a base portion 42 with upper surface 21 inclined at an angle of about 8 to 15 degrees relative to the horizontal. The upper housing portion 44 is inclined at an angle A of about 8 to 15 degrees from the vertical, as shown in FIG. 5. This angle allows the housing 22 to drain completely when cleaned so that no flat or horizontal surfaces are provided which could allow residual liquid to stand or accumulate. The front face 25 of the wear block 23 extends at an angle B of about 8 to 15 degrees relative to the transverse axis of the housing 22. The purpose of constructing the wear block 23 with the angle B as described is to allow the pressure of the latch cam 36 to retain the wear block 23 in the latch dog housing 22 during normal operation without the use of mechanical fasteners or the like. Thus the front face 25 of the wear block 23 will match up with the angular face or pitch of the cam 36. Also, this construction assists in providing close engagement of the cam 36 and its lug 46 with the housing 22 in the closed position of the door 14 as shown in FIG. 2. The lug 46 serves as a stop when engaged with the wear block 23 as shown in FIG. 2.

The upper housing portion 44 includes a vertical end wall 45 and two vertical side walls 47, 49. Each side wall 47, 49 has a respective end rib 50, 52 which engages corresponding shoulders 54, 56 on the wear block 23. As shown in FIG. 4, side wall 49 is of greater length than side wall 47, allowing a similar amount of the wear block 23 in a longitudinal direction to be exposed across the angled face 25 of the block 23, and also preventing the wear block 23 from being installed in an inverted position. In this manner, a similar amount of the wear block 23 can be worn down across the angled face 25 of the block 23 during use of the latch dog assembly.

The latch dog housing 22 is preferably constructed of stainless steel or other suitable metals and the wear block 23 is preferably of UHMW polyethylene plastic, for sanitation purposes and to reduce friction between moving parts during operation.

The wear block 23 is easily removed by applying a screw driver or similar tool through a horizontal opening 40 in the back of the latch dog housing 22. Such construction provides for easy removal or replacement of the wear block 23 without the use of special tools and also provides for thorough cleaning from the inside or outside of the bin 12. As shown in FIG. 6, the opening 40 should be of sufficient size to allow a screw driver blade or other similar implement to be inserted underneath the back side of the wear block 23. Additionally, the wear block 23 is constructed of a material such as UHMW polyethylene plastic having a low coefficient of friction to assist in ease of operation of the latching mechanism.

In the operation of the latch dog assembly 10, upon closing the door 14, the latch cam 36 clears the latch dog housing 22 as the lower edge of the door 14 engages the bin wall 18. The bolt head 35 is tightened so as to rotate the bolt 34 and apply the latch cam 36 to the wear plate 23, which thus avoids any undesired metal to metal contact. As the force applied to the cam 36 increases, the latch bolt 34 is compressed inwardly so as to obtain the desired seal for use in FDA, USDA and PHARM environments in which leakage of the bin contents must be prevented.

What is claimed and desired to be secured by Letters Patent is:

1. A latch dog assembly for a bin used in storing and transporting bulk material, said bin having an opening for discharge of said material and a hinged door with cam means for opening and closing said opening, said latch dog assembly comprising a latch dog housing for mounting in a fixed position in said bin adjacent said opening, said latch dog housing having a base portion with an upper and lower surface, the upper surface being inclined at an angle relative to the lower surface, and with said housing having a three-sided enclosure with an end wall and two side walls mounted on said base portion, said end wall extending at an angle to the vertical so as to be substantially perpendicular to said upper surface, and a wear block positioned in said housing for contact with said cam means.

2. The latch dog assembly of claim 1 wherein said wear block is constructed of UHMW polyethylene plastic or similar material of low friction.

3. The latch dog assembly of claim 1 wherein said wear block has a front face which extends at an angle of 8 to 15 degrees relative to the transverse axis of the housing.

4. The latch dog assembly of claim 1 wherein said housing has an opening in the end wall behind the position at which said wear block is inserted so as to aid in removal of said wear block and in cleaning of said housing.

5. The latch dog assembly of claim 1 wherein said upper surface is inclined at an angle of 8 to 15 degrees relative to the horizontal.

6. The latch dog assembly of claim 1 wherein said end wall lies in a plane which extends at an angle of 8 to 15 degrees relative to the vertical.

7. The latch dog assembly of claim 3 wherein said wear block has two opposite side faces, one of which is of greater length than the other, and wherein one of the side walls of said enclosure is of greater length than the other, with the longer side face of said wear block being adjacent the longer side wall of said enclosure, thus allowing a similar amount of the wear block in a longitudinal direction to be available for wear across the angled face of said wear block.

* * * * *